US010337245B2

(12) United States Patent
Grillberger

(10) Patent No.: US 10,337,245 B2
(45) Date of Patent: Jul. 2, 2019

(54) ACCESS CONTROL DEVICE

(71) Applicant: NOVOMATIC AG, Gumpoldskirchen (AT)

(72) Inventor: Walter Grillberger, Herzogsdorf (AT)

(73) Assignee: NOVOMATIC AG, Gumpoldskirchen (AT)

( * ) Notice: Subject to any disclaimer, the term of this patent is extended or adjusted under 35 U.S.C. 154(b) by 0 days.

(21) Appl. No.: 15/023,618

(22) PCT Filed: Sep. 19, 2014

(86) PCT No.: PCT/EP2014/002546
§ 371 (c)(1),
(2) Date: Aug. 2, 2016

(87) PCT Pub. No.: WO2015/039761
PCT Pub. Date: Mar. 26, 2015

(65) Prior Publication Data

US 2016/0333632 A1 Nov. 17, 2016

(30) Foreign Application Priority Data

Sep. 20, 2013 (DE) ..... 20 2013 008 332 U
Jan. 10, 2014 (DE) ..... 20 2014 000 198 U

(51) Int. Cl.
*E06B 11/08* (2006.01)
*E06B 3/90* (2006.01)
(Continued)

(52) U.S. Cl.
CPC ..... *E06B 11/08* (2013.01); *E06B 3/90* (2013.01); *E06B 11/085* (2013.01); *G07C 9/02* (2013.01);
(Continued)

(58) Field of Classification Search
CPC ..... G07C 9/02; E06B 11/08; E06B 11/085; E06B 3/40
See application file for complete search history.

(56) References Cited

U.S. PATENT DOCUMENTS 1,841,132 A * 1/1932 Kennedy ..... E06B 11/08 49/47
3,374,872 A 3/1968 Guillerm
(Continued)

FOREIGN PATENT DOCUMENTS

AT 509119 B1 12/2012
DE 2202746 A1 7/1973
(Continued)

OTHER PUBLICATIONS

Alvarado Manufacturing Co., "Security Turnstiles, Model CPST", Jul. 18, 2009; URL:http://bit.ly/1FwuFa3.
(Continued)

*Primary Examiner* — Catherine A Kelly
(74) *Attorney, Agent, or Firm* — Avery N. Goldstein; Blue Filament Law PLLC

(57) ABSTRACT

The present invention relates to an access control device having at least one turnstile which has at least one barrier element that forms a turnstile arm and can be moved into a blocking position in which it blocks the access and into an access position in which it opens the access, an illumination device for illuminating the barrier element being provided. According to the invention, the barrier element forms an at least approximately planar illuminating panel that is made of a transparent material at least in sections and is fastened to a turnstile post at one end section and otherwise projects out freely. In particular an on-screen display element can be integrated into the barrier element and/or can form the barrier element, wherein said on-screen display element can
(Continued)

be made of electronic paper with an image-storing function for the changeable display of information.

21 Claims, 8 Drawing Sheets

(51) Int. Cl.
*G07C 9/02* (2006.01)
*E04B 2/74* (2006.01)
*F21Y 105/00* (2016.01)
*F21Y 101/00* (2016.01)

(52) U.S. Cl.
CPC ..... *E04B 2/7435* (2013.01); *F21Y 2101/00* (2013.01); *F21Y 2105/00* (2013.01)

(56) References Cited

U.S. PATENT DOCUMENTS 3,893,259 A * 7/1975 Nineberg ..... E05D 15/02 49/41
3,913,717 A 10/1975 Collins
3,988,570 A 10/1976 Murphy et al.
4,026,069 A * 5/1977 Bohnett ..... A01K 3/00 119/840
4,184,289 A * 1/1980 Lambertson ..... E06B 11/08 49/42
4,195,442 A 4/1980 Keeling et al.
4,344,628 A 8/1982 Warehime
4,358,909 A * 11/1982 Trikilis ..... E05D 15/02 403/205
5,349,781 A 9/1994 Libardi
5,592,778 A * 1/1997 McGuire ..... E06B 11/08 49/141
5,819,470 A * 10/1998 Kionecka ..... E06B 11/08 49/46
6,324,800 B1 12/2001 Valentz et al.
6,780,501 B2 * 8/2004 Bruneau ..... C08L 33/12 428/218
6,845,970 B1 1/2005 Kenton
6,873,266 B2 * 3/2005 Blum ..... A47L 23/22 15/215
7,404,517 B2 * 7/2008 Wallerstorfer ..... A63C 11/005 235/375
7,513,423 B2 * 4/2009 Kocznar ..... G07C 9/00944 235/382
7,553,103 B2 6/2009 Jameson et al.
D602,175 S 10/2009 Droomer
7,707,951 B1 5/2010 Prasad
7,743,556 B2 6/2010 Stoffels
7,823,338 B2 * 11/2010 Slagel ..... E04H 1/1205 52/33
8,079,515 B2 * 12/2011 Kocznar ..... E06B 11/085 235/380
8,136,297 B2 * 3/2012 Bzorgi ..... E05F 15/40 49/138
8,269,603 B2 * 9/2012 Aoki ..... G07C 9/00158 340/5.82
8,657,190 B2 * 2/2014 Lais ..... G07C 9/00087 235/380
8,819,855 B2 8/2014 Prasad et al.
9,206,642 B2 * 12/2015 Harucksteiner ..... E06B 11/08
2002/0050098 A1 * 5/2002 Chan ..... E06B 11/08 49/42
2005/0056741 A1 3/2005 Higgs et al.
2005/0241234 A1 11/2005 Ginzel
2011/0100405 A1 * 5/2011 Fournier ..... E04H 1/1227 135/96
2011/0292214 A1 12/2011 Plaster
2012/0024329 A1 2/2012 Ma
2012/0044047 A1 2/2012 Morgan
2013/0062585 A1 3/2013 Deering
2013/0199094 A1 8/2013 Lachance et al.
2016/0284142 A1 * 9/2016 Elbling ..... E06B 11/08
2016/0305141 A1 * 10/2016 Slagel ..... E04H 1/1227

FOREIGN PATENT DOCUMENTS

DE 8510933 U1 5/1986
DE 8912064 U1 3/1990
DE 4124567 A1 1/1993
DE 29724321 U1 12/2000
DE 20321489 U1 12/2007
DE 102006050635 A1 4/2008
DE 102010015774 A1 10/2011
DE 102010024108 A1 12/2011
DE 202012101181 U1 5/2012
EP 2234073 A1 9/2010
EP 2259226 A1 12/2010
EP 2306406 A1 4/2011
EP 2306406 B1 4/2012
FR 891808 A 3/1944
FR 2176208 A5 10/1973
FR 2808048 A1 10/2001
WO 0129355 A1 4/2001
WO 0175243 A1 10/2001
WO 2004092524 A1 10/2004
WO 2007136244 A1 11/2007

OTHER PUBLICATIONS

Alvarado Manufacturing Co., "Security Turnstiles, Model CPST", Alvarado Manufacturing Co., 12660 Colony Street, Chino, CA 91710, Jul. 18, 2009, 2 pages; https://web.archive.org/web/20090718095252/http:/www.alvaradomfg.com/pdf/datasheets/cpst_data.pdf.
German Search Report dated May 22, 2014 for German Application No. 20 2013 008 332.8 filed Sep. 20, 2013.
International Search Report dated Feb. 4, 2015 for International Application No. PCT/EP2014/002546 filed Sep. 19, 2014.
International Search Report dated May 20, 2015 for International Application No. PCT/EP2014/002545 filed Sep. 19, 2014.

* cited by examiner

ACCESS CONTROL DEVICE

FIELD OF THE INVENTION

The present invention relates to an access control device having at least one turnstile which has a turnstile post and at least one barrier element, which barrier element forms a turnstile arm and can be moved into an access blocking position in which the barrier element blocks the access and into an access position in which the barrier element unblocks the access, wherein an illumination device for illuminating the barrier element is provided.

BACKGROUND OF THE INVENTION

Such access control devices control the access to areas located behind the barrier element and can, for example, be used at buildings or places to control access for persons to the area located behind the device. Such access control devices can be found, for example, in security-sensitive buildings such as banks, casinos, airports, or buildings and places that require an entrance fee such as amusement parks, stadiums, and the like. In addition to controlling the access of persons, controlling the access of vehicles, such as motor vehicles or bicycles, can generally also be taken into consideration, as is already known, for example, in car parks, in the form of parking barriers.

In the blocking position of the barrier element, the barrier element thereby blocks an access path or an access port that leads into the area behind the device, while said access path is unblocked by the barrier element in the access position of the barrier element.

The barrier element can thereby form, for example, the arm of a turnstile and can be rotatably supported about the axis of rotation of the turnstile. Alternatively, however, the barrier element can also be a flap that can be swung back and forth, which is sometimes referred to as a flap gate, and which, for example, can be swung back and forth around an upright pivot axis, which pivot axis can be located next to the access path. The barrier element can, however, also be designed as a gate that can move up and down around a horizontal axis, for example, in the form of a blocking arm which can be moved from a lying barrier position, that runs across the access path, to an upright access position, or that can be pulled inwards and extended outwards in a translatory, sword-like manner.

Such access control devices on the one hand should be as secure and tamper-resistant as is possible, in particular, to prevent unauthorized passing/access past the access control devices. On the other hand, the access control devices should have the highest possible intuitive and easy operation such that the access control devices do not scare off persons that are authorized to pass, but grant access in an inviting and simple manner.

Although conventional access devices such as turnstiles, for singularization of a stream of people, having head-high turn stops, provide a relatively high protection against unauthorized access, said conventional access devices are relatively large, elaborate, difficult to operate, and have a deterrent appearance. On the other hand, simple turnstiles having, for example, a single blocking arm, are easy to get around and often do not meet the required level of security.

An access control device for ski-lifts is already known from EP 23 06 406 B1, in which an RFID reader module is integrated in the barrier element in order to avoid separate fittings for reading RFID access cards and to achieve a compact, small design. To save power and to avoid unnecessary radiation, the RFID reader module is only activated once the approach of a person at the barrier element is detected by means of an additional sensor.

A similar access control device having a movable barrier element in the form of a single blocking arm that can be swung back and forth is known from EP 22 34 073 A1. In order to prevent a climbing over or crawling under the barrier element, sensors are mounted above and below the barrier element on the post-shaped portal on which the barrier element is movably mounted, for example, in the form of a light barrier or of a radar sensor, which trigger an alarm when climbing over or crawling under the barrier element is detected.

An access control device for ski-lifts is known from AT 509 119 B1, wherein support posts, positioned at the right and left of the access path, support a swiveling barrier element. In addition, protruding plastic bodies are attached to the support posts parallel to the access path, in which support posts readers for RFID smart cards or similar access openers are housed. To support intuitive operation, lighting fixtures are also attached to the support posts in order to illuminate said receiving bodies for the card reader in the manner of a traffic light. For example, if a valid card is recognized by the reader, the reader housing is lit green, while the reader housing can be illuminated in red, when an invalid card is read.

Furthermore, a revolving door is known from DE 10 2010 024 108 A1, the swing leaves of which consist of glass panels and are combined to form a turnstile which can be driven by an electric motor. To set the electric motor in motion, on the one hand a sensor for detecting approaching persons is located on the drum which partly surrounds the revolving door and is arranged in a fixed manner, and on the other hand a door activation switch for manual operation is provided.

SUMMARY OF THE INVENTION

Proceeding from this, the problem addressed by the present invention is that of providing an improved access control device of the aforementioned type which avoids the disadvantages of the prior art and further develops the latter in an advantageous manner. In particular, an intuitive, easy operation for persons authorized to pass should be achieved, while at the same time a high level of security against unauthorized access is achieved.

According to the invention, this problem is solved by an access control device according to claim 1. Preferred embodiments of the invention are subject of the dependent claims.

Thus, according to the invention, the barrier element is designed as an approximately plate-shaped light-emitting element, such that by directly illuminating the barrier element, a light signal can be given to the person seeking access, which light signal is easily recognizable by the person seeking access. According to the invention, the barrier element forms an at least approximately plate-shaped light-emitting element that is formed at least partially of a transparent material and is attached at a first end portion to the turnstile post and freely projects at a second end portion. As a result, no separate components are required, which would require additional space, such that overall a small-sized, compact design of the access control device can be achieved. By means of the transparent design of the barrier element forming a turnstile and the cantilevered mounting thereof directly at the turnstile post, the turnstile allows visibility towards the blocked area behind the turnstile. The at least approximately plate-shaped light-emitting element can thereby only be clamped by means of a narrow edge strip at the first end portion of the light-emitting element, or can otherwise be attached to the turnstile post, while the remaining, significantly larger part of the corpus of the light-emitting element is cantilevered away free and unsupported from the attachment point. The light-emitting element may thereby have an elongate, significantly longer than wide outline, for example, in the shape of a sword, and may be clamped only at the narrow end thereof. Said first and second end sections may therefore be the ends in the longitudinal extension.

Since the light-emitting element is at least in some parts made of transparent material, looking through the barrier element is at least possible when the illumination device is switched off. In particular, the aforementioned light-emitting element can be designed transparent or translucent, or sheer, respectively, to allow at least a relatively good visibility of the area controlled by the access control device when the illumination device is switched off. Such a design of the barrier element, that is at least partially transparent, allows, for example, to turn off the illumination device to enable an approaching user to see what is awaiting the user behind the access control device. By switching on the illumination device on the other hand, the visibility of the barrier element can be increased or supported to prevent an accidental collision with the barrier element.

In an advantageous further development of the invention, said illumination device can be associated with the barrier element such that the illumination device moves together with the barrier element when the barrier element is moved into the barrier position thereof and/or in the access position thereof. In particular, the illumination device can be integrated into the barrier element, for example, housed inside the barrier element or at least arranged directly on the barrier element. By an arrangement of the illumination device that moves with the barrier element, an equally high-quality of lighting can be achieved by means of a simple embodiment of the illumination device in the various positions of the barrier element. The barrier element can illuminate uniformly or be illuminated uniformly, regardless of the position in which the barrier element is located and/or whether the barrier element is being moved or is resting.

The lighting of the barrier element can also be used to selectively transmit information in the form of light signals directed to the person requiring access. These can, on the one hand, be relatively simple light signals, for example, different colors of light, which can be achieved by different colored light source designs of the illumination device.

On the other hand, complex information can be transmitted to the person requiring access, for example, in the form of texts and/or images. For this purpose, a more complex illumination device can also be designed, for example, comprising a pixel-like illuminated dot matrix.

In particular, the illumination device can comprise at least one display element that can be incorporated into the barrier element and/or may form the barrier element. Such a display element can be formed, for example, as a flat screen.

Alternatively or additionally, a display element from electronic paper having an image memory function for variable information display, can be provided. Such an electronic paper, sometimes referred to as e-paper, regularly includes at least two thin film layers between which microcapsules can be included having differently colored pigment particles, which can be electrically charged. The two films serve as negative or positive electrodes, such that, depending on the application of the appropriate voltage, different pigment particles are oriented to the surface of the one or of the other film. In particular, each of the aforementioned film layers may comprise an electrode grid, whereby a pixel grid and thus a corresponding information presentation, such as on a screen, is possible.

Such electronic paper can be applied, for example, to the above-mentioned light-emitting element. Alternatively, the electronic paper can also be sandwiched between two light-emitting element panels or layers and/or can form a layer of the light-emitting element.

In this case, the electronic paper provides a permanent display of the respective information or of the corresponding icon, even without constant power supply. Alternatively, however, a volatile formation of the electronic paper may be provided also to allow an undisturbed vision through the light-emitting element when the power supply is switched off.

In a simple embodiment of the invention, two-colored electronic paper can be used, the pixels of which can be switched back and forth between two color states. In particular, a black/white electronic paper may be used. Alternatively however, a multicolored electronic paper can be applied as a display element on the roll and/or the control key in a further development of the invention, which would allow colored representations. Such multicolored electronic paper can obtain the color thereof by means of filters which are worked on the film or on the thin film layer of the electronic paper. In the further development of the invention however, a multilayer electronic paper can be provided as a display element in which a plurality of color layers are arranged one above the other, wherein each layer may consist of a film pair and of interposed color pigment particles. Compared to the aforementioned filtering solution, such a multilayer electronic paper is characterized by high color brilliance and clarity of presentation.

To change the view displayed by the electronic paper in a simple way, a further development of the invention can provide for a power and/or data transfer connection on the barrier element and/or the turnstile via which the electronic paper is supplied with electricity or with relevant data.

Alternatively or additionally, a complex display of information can also be achieved by a relief-like surface formation of the light-emitting element, for example, by elevated or recessed letter contours, which give readable information when illuminated or back-lit.

Alternatively or in addition to a visual presentation on the barrier element, the access control device can comprise an acoustic device that can communicate acoustic information and signals to a person using the access control device or approaching the device. In particular, notifications of actions related to the access control, such as activating the barrier element, the refusal of access, or the triggering of other safety devices such as light barriers and the like can be indicated acoustically. For this purpose, when further developing the invention, the acoustic device can comprise at least one speaker, which can advantageously be provided on a structural element of the access control device, such as an enclosure of the access or a portal, with which the named barrier element cooperates.

In a further development of the invention, the illumination device may be associated with the light-emitting element such that the light-emitting element can be illuminated and/or translucent from the inside. As a result, the barrier element has a high luminosity from different angles.

In an advantageous further development of the invention, the preferably approximately plate-shaped light-emitting element or light-emitting panel may be illuminated at lease at the front side thereof by the illumination device in a planar manner. Thereby said front side is the largest side of the light-emitting element with regards to the surface, which light-emitting element, in the blocking position of the barrier element, is aligned transversely by the access control device or is oriented approximately perpendicular to the view axis of a person moving through the access control device. The light-emitting element may thereby form a substantially flat plate, but alternatively can also have some curvature, for example, in terms of a bulging surface, wherein the surface may advantageously be at least contoured approximately smooth or at least have a harmonious contour. Alternatively, a relief-like contour of the light-emitting element is generally possible, for example, in order to achieve special lighting effects.

Hereby the surface illumination of the light-emitting element can be generally done in various ways. For example, a grinding slanting irradiation of the front side to be illuminated can be provided at an acute angle of the light arriving from the illumination device. In particular, the front side of the light-emitting element can be irradiated from the front in a grinding slanting manner. The illumination device can thereby comprise at least one light source at one edge of the light-emitting element, the light of which light-emitting element is emitted at an acute angle diagonally on the front side and from the front side is reflected or scattered such that the front side is flatly lit. Alternatively or additionally, if necessary, the back side can be irradiated in the said grinding manner, such that the light passes through the light-emitting element that is, at least in this case, transparently or translucently formed, and can be radiated on the front side. The light-emitting element can thereby be reflective, at least in some sections, and/or can scatter light, for example, be satin-formed.

Alternatively or in addition to such a lighting of the front and/or back of the light-emitting element coming from the outside, the light-emitting element can, however, in a further development of the invention, also be illuminated from the inside. For this purpose, the light-emitting element can, at least in some sections, be formed of a light-conducting material and turned with at least one of the narrow sides of the light-emitting element towards the illumination device, such that in the narrow side of the light-emitting device, light from the illumination device can be coupled. The coupled light can propagate in the light-conducting material of the light-emitting element and can be radiated on the front and/or back side of the light-emitting device, for example, by means of a refractive forming of the front and/or back side.

The illumination device may comprise at least one light source which is arranged in the narrow side of the light-emitting element and irradiates light onto the aforementioned narrow side.

In an advantageous further development of the invention, the aforementioned illumination device may comprise a line of LEDs that can sit directly on the so-called narrow side of the light-emitting element, in particular be attached thereto. Alternatively, the so-called LED lighting strip however, can also be arranged spaced away from the narrow side, for example, can be positioned on an edge on the light-emitting element frame and/or support element, which encloses the light-emitting panel on the edge thereof at least in some sections. However, a direct arrangement of the LED lighting strip on the narrow side of the light-emitting element can be advantageous in order to achieve the highest possible coupling gradient.

In the further development of the invention, said LED light strip can be arranged between the narrow side of the lighting panel and the frame enclosing the lighting panels, whereby in an advantageous further development of the invention, said frame has a multi-limbed, for example L-shaped or U-shaped cross-section and the lighting panel can be covered on at least two sides, in particular, said narrow side and in the area of a narrow edge strip of the front or rear side. In a U-shaped cross-sectional configuration of said frame part the light-emitting panel can be encompassed on three sides, namely from the narrow side and the two adjacent, opposing front and rear sides. In this way, a protected arrangement of the LED lighting strip can be achieved. In an advantageous further development of the invention, the mentioned enclosing frame part can take the form of an elongated thin profile part or the form of a narrow edge web, the thickness and height of which is very small compared to the extension and longitude of the light-emitting element, in particular, encloses only a narrow edge strip of the light-emitting element.

In an advantageous further development of the invention the entire surface of the light-emitting element is illuminated by the illumination device. For example, only a small edge strip and, if necessary, an attachment section of the light-emitting element, trimmed by the aforementioned edge web, is excluded from the illuminability. The non-illuminated surface and/or non-visible illuminated surface of light-emitting panel can be advantageously less than 10% of the entire surface of the light-emitting element.

To achieve a high level of security against unauthorized access in terms of exceeding or falling through the barrier element, a sufficiently large area, in particular sufficiently high and ground level construction of the barrier element can be provided in a further development of the invention. If a transparent or at least sheer light-emitting element is used in the manner described above for the barrier element, a welcoming effect can be achieved with an intuitive and simple handling and a deterrent effect can be avoided.

Alternatively or additionally, a plurality of barrier elements can be arranged one above the other and together form an access barrier in an advantageous further development of the invention, wherein said plurality of barrier elements advantageously can be at least approximately arranged in a common, in particular upright plane. Said multi-barrier elements can thereby form strip-shaped locking arms, which can be configured in the aforementioned manner respectively as light-emitting element and can be spaced apart from each other. As a result, different lighting effects can be implemented in various sections of the barrier in a simple manner, for example, by illuminating various barrier elements in different ways.

To further improve the security of the access control and, for example, to avoid improper climbing over or crawling under of the barrier element, an advantageous further development can provide a sensor monitoring device for monitoring the access blocked by the at least one barrier element, wherein the sensor installation can, in particular, monitor an area unrestricted by the barrier element and/or is able to monitor an area adjacent to the barrier element. In an advantageous further development of the invention, the sensor installation can monitor an area above the at least one barrier element in the locking position thereof and/or an area below said barrier element, wherein the sensor installation can advantageously be of such a nature that a signal is given in cases of intrusion of an object into said areas, for example, to trigger an alarm, which can be issued, for example, to the aforementioned acoustic device.

The sensor alignment can be coupled to a control device of the access control device to only emit a signal when the barrier element is in the blocking position thereof and/or is not released, to avoid incorrect indications when an authorized person passes the access.

Said sensor installation can be constructed differently, for example, comprising a light barrier sensor system and/or a radar sensor. The sensor installation can advantageously be mounted to a side limit and/or to an upper limit that monitors the access. For example, the sensor system can be integrated into a portal which surrounds the access controlled by the barrier element. If the barrier element is integrated into a turnstile in the manner described above, the sensor installation can monitor the space above the turnstile which is monitored by the portal. The access control device can thereby include a plurality of access gates, for example, an access gate for controlled access to a room and an exit gate to exit from said area, wherein said exit gate can be designed as an emergency exit gate, for example. Said access gate and said exit gate can thereby have a different design, whereby, for example, in a further development of the invention, at least one access turnstile and at least one exit flap gate or one exit barrier can be provided. Said access turnstile and said exit barrier, and in particular, emergency exit barrier can each comprise at least one barrier element that can be illuminated, as described previously.

To allow flexible use at different locations without complicated installation work, to be able to variably delimit different spatial areas, for example, in a casino or a meeting room, according to one aspect of the present invention the movable barrier element can be supported on a barrier carrier which is constructed as a free-standing element that has its own means of ground contact for an anchorage-free, variable-positioning set-up of the barrier element on the floor. By means of such a barrier carrier having said ground contact means, the access control device, in particular, also can be used functionally without any anchorage to the ground, wherein the means of contact to the ground can be advantageously designed such that the means of contact to the ground can be moved, such that the entire access control device, but at least the barrier element, can be moved along the floor and relocated.

In particular, a base plate can be provided, the underside of which can form said ground contact means or the base plate of which can be connected to said ground contact means. For example, the base plate can have on the underside thereof, projections or bulges, such that the whole underside of the base plate does not stand on the floor, but only said projections, for example, to ensure a level footing on uneven floors. Alternatively or additionally, a supporting arm or the like may be attached to the base plate, to form said means of ground contact. The base plate needs not form a panel in the strict sense in terms of a flat panel, but can be embodied in the form of a support or frame structure or of a truss structure or similar rigid structure whose contact points are in a plane or advantageously are designed such that the contact points can be adjusted.

A support bearing said barrier element, in particular in the form of a turnstile post, can be braced on such a base plate, such that said support, in particular turnstile posts, does not have to be anchored in the ground.

Advantageously, the aforementioned base plate can connect the support bearing the barrier element, in particular, the turnstile post, by means of a side limit enclosing the access, in particular in the form of a portal post, such that the support of the barrier element and the side limit above the base plate form a structural unit that can be set-up in a simple manner.

In particular, the turnstile post bearing the barrier element can be supported on the floor by means of a lower end on the bottom plate and linked by an upper end to a portal cross element, which is connected to said portal posts. The portal, the bottom plate, and the turnstile can in particular embody a pre-assembly component and/or a structural unit, which can be positioned in varying locations and can in particular be moved on the ground by pushing in order to delimit a defined area.

In order to delimit different room areas variably and to allow the adaptation of structural spatial elements such as walls and the like, according to a further aspect of the present invention, a side limit is provided which laterally encloses the at least one barrier element and/or a continuing side limit is provided, which has a modular design and is assembled from a plurality of side parts, which can be put together in variable ways and together form said side limit. Such modular side limit of the access device allows the simple connection of the access device to spatial structures such as room walls, even when there are different room dimensions.

In the further development of the invention, the side panels can be connected to one another in an articulated manner by coupling means, such that the side panels can be mutually positioned to each other by pivoting in different angular positions. The coupling means are connected advantageously as releasable such that a different number of side panels in said manner can be connected with each other, depending on how long the side limit shall reach.

The coupling means can in particular realize an upright hinge axis, that connects the adjacent side parts to one another, such that the adjacent side parts can be hinged relative to each other around the connected upright axis. Advantageously, the side limit can be connected in an articulated manner to a side limit enclosing the access which can be blocked by the barrier means by means of corresponding coupling means, in particular in the form of a portal post, connected and relative to said side limit in different angular positions. In particular, the side limit can be advantageously hinged around an upright axis opposite the portal that frames the access.

BRIEF DESCRIPTION OF THE DRAWINGS

The invention is explained in detail below using a preferred embodiment and associated drawings. In the drawings.

DETAILED DESCRIPTION OF THE INVENTION

Figure 1:
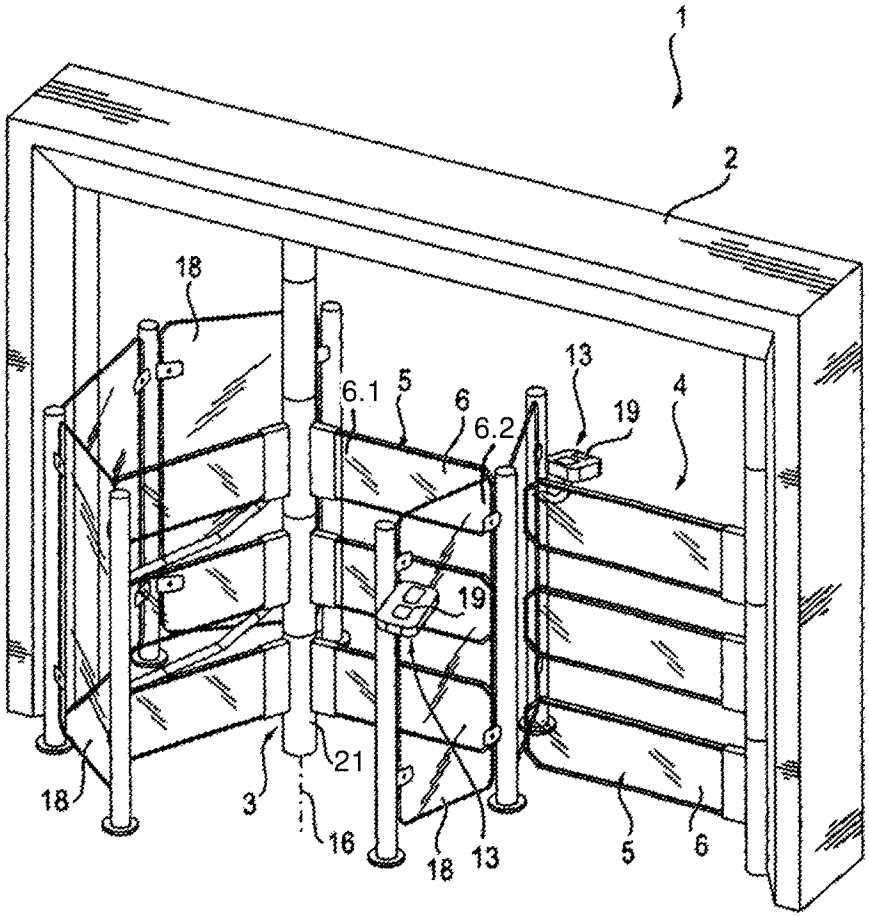
FIG. 1: a schematic, perspective view of an access control device according to an advantageous embodiment of the invention, which comprises, in addition to a turnstile having a plurality of locking arms, an exit gate having barrier elements that can be swung back and forth.
Figure 2:
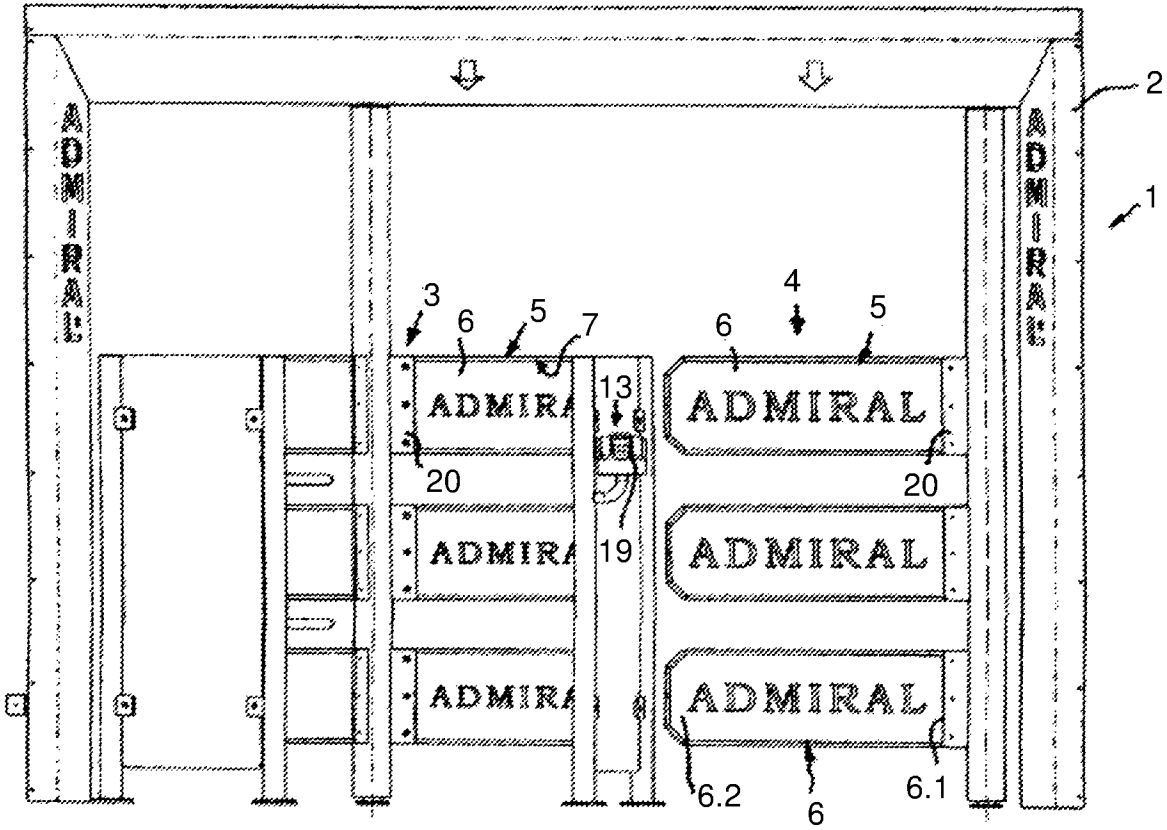
FIG. 2: a front view of the access control device from FIG. 1 that shows the access turnstile and the exit gate in a blocked position.

As FIGS. 1 to 4 show shows, the access control device (1) can be configured as a person access control that separates an access-controlled room behind the access control device (1) from, for example, an area in front of the access control device (1). The access control device (1) can comprise a portal (2), which comprises two portal posts arranged on either side of an access path, onto which further blocking measures, such as walls, a fence or the like, can be connected. As shown in FIG. 1, said portal (2) can comprise a crossbar, which connects the portal posts with each other at the top, such that the portal (2) is formed overall in the manner of a door frame.

The access through said portal (2) is regulated by a movable barrier that can be designed in the form of a turnstile (3), and that can extend into the passage section enclosed and monitored by the portal (2). In particular, said turnstile (3) can comprise an upright axis (16), along which a central turnstile post (21) extends, which is mounted rotatably at the lower and/or upper end thereof and can be rotationally driven by a drive in a generally known manner, which drive is not shown in more detail here.

Figure 3:
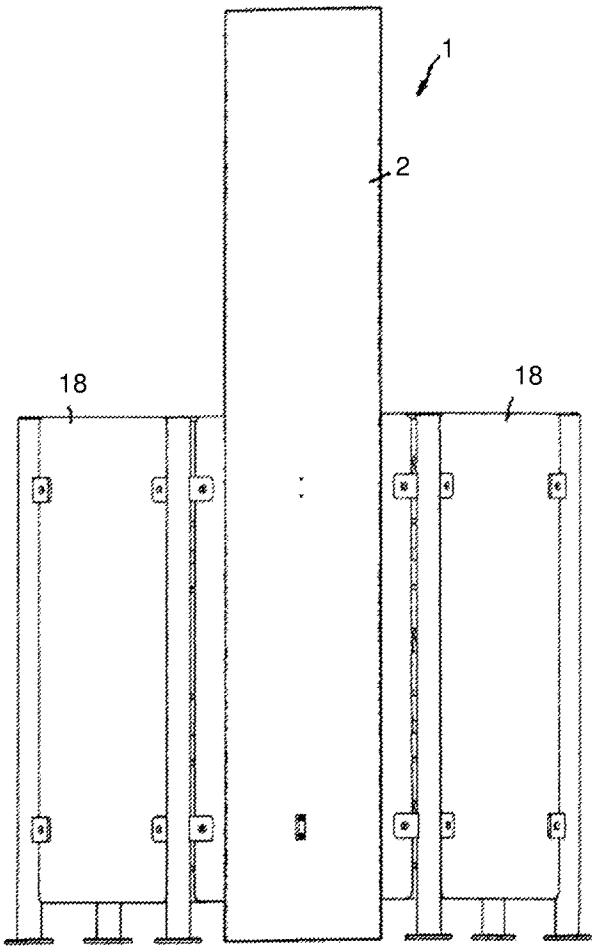
FIG. 3: a side view of the access control device of the preceding figures.
Figure 4:
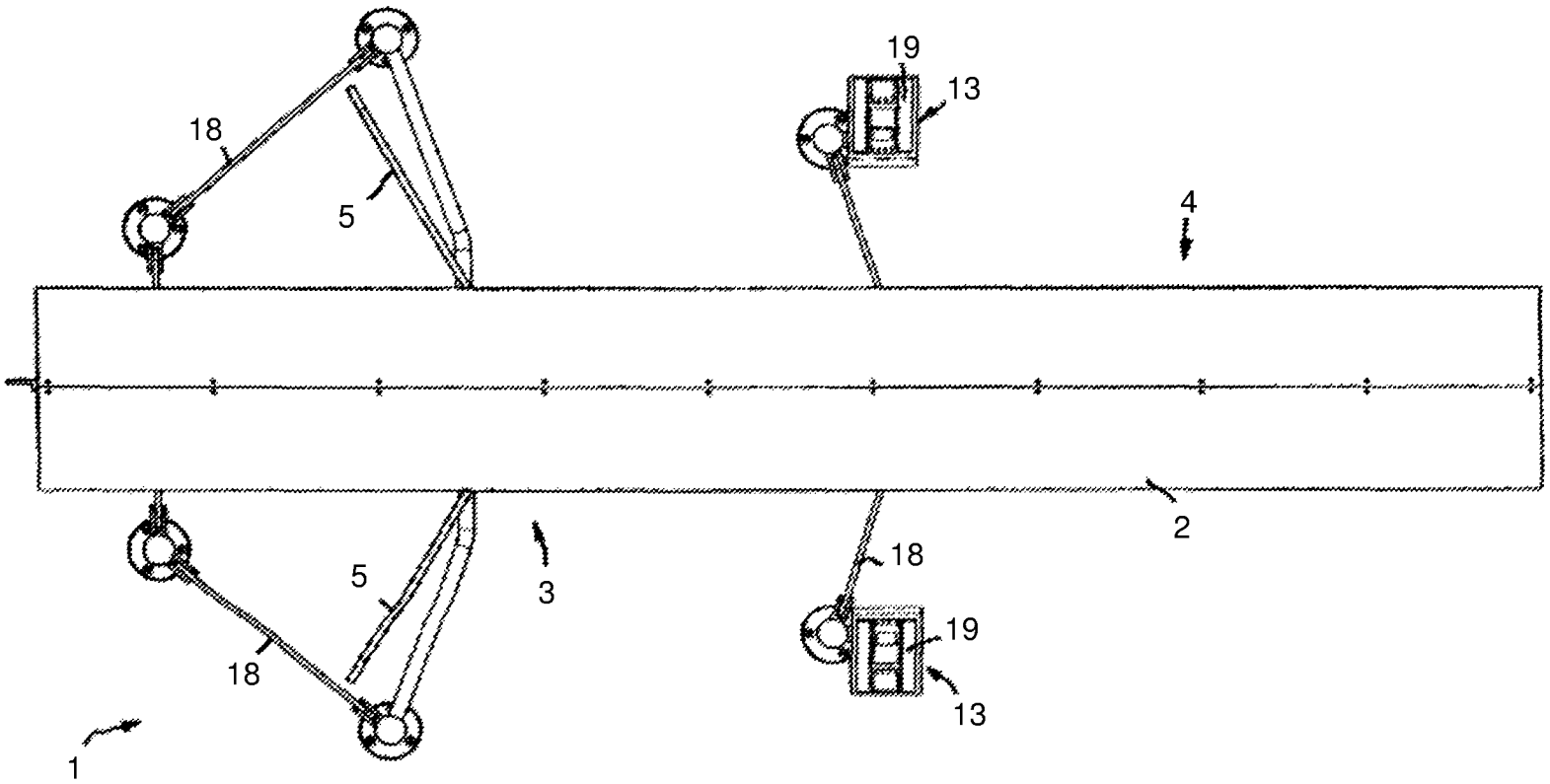
FIG. 4: a plan view of the access control device from the preceding figures.

Crosswise projection barrier elements (5) are fixed on said turnstile post (21), which can be distributed circumferentially around the turnstile post (21) in a plurality of groups, according to FIG. 3 in three groups, to subdivide the area around the turnstile post (21) into a plurality of sectors.

Advantageously, a plurality of barrier elements (5) are each arranged above one another, which can lie in an upright plane, in particular in a level parallel to the turnstile posts (21) or in a level contained in the turnstile axis of the turnstile, as shown in FIG. 1, but optionally can also have a slight offset to each other, for example, to grant more leg and knee clearance. Advantageously, the barrier elements (5), approximately arranged at one level, extend close enough to the ground to prevent sliding or crawling under the barrier, and on the other hand, extend high enough to prevent climbing over. On the whole, a head-high barrier can be designed, which, as FIG. 1 shows, can consist of a plurality of superposed barrier elements (5). Alternatively, it would also be possible to design a barrier element (5) so high that a corresponding head-high barrier is formed.

The turnstile (3) and the barrier elements (5) sweep over an approximately cylinder-shaped space, which may be surrounded by an approximate drum-shaped arrangement of boundary walls (18). As FIG. 1 shows, said boundary walls (18) can be formed from glass or plastic panels, which are fastened to the boundary posts.

Said turnstile (3) forms, in this respect, an access gate and thereby controls the access. For example, the turnstile (3) can, in principle, be blocked and by means of detection sensors (13) can be released when a person seeking access and/or the authorization of a person seeking access is detected. For example, said detection sensors (13) can comprise an identification reader (19) by means of which an RFID chip, an identity card, or similar access codes, for example, can be read. Optionally, fingerprint readers, iris readers, or simply entrance card readers, for example, are conceivable.

If the turnstile (3) has a rotary drive, the drive can be set in motion by the detection sensors (13) when a person authorized to access is detected, to continue the rotation of the barrier elements (5) at the turnstile (3) and to thereby give access.

As FIG. 1 shows, in addition to the turnstile (3) a further access or exit gate can be provided, which can likewise be blocked by three superposed barrier elements (5) and regularly blocked and released by detection sensors (13) in a similar manner as already described.

The barrier elements (5) of the exit gate (4) can be configured as pivoting flaps or as a flap gate respectively, whereby the horizontally arranged barrier elements (5) may be pivotally mounted at one end around upright pivot axes. The exit gate (4) can in particular serve as an emergency exit.

Similar as described for the turnstile (3), the barrier elements (5) of the exit gate (4) can also form an entire head-high barrier to prevent both climbing over and going under the barrier.

Figure 5:
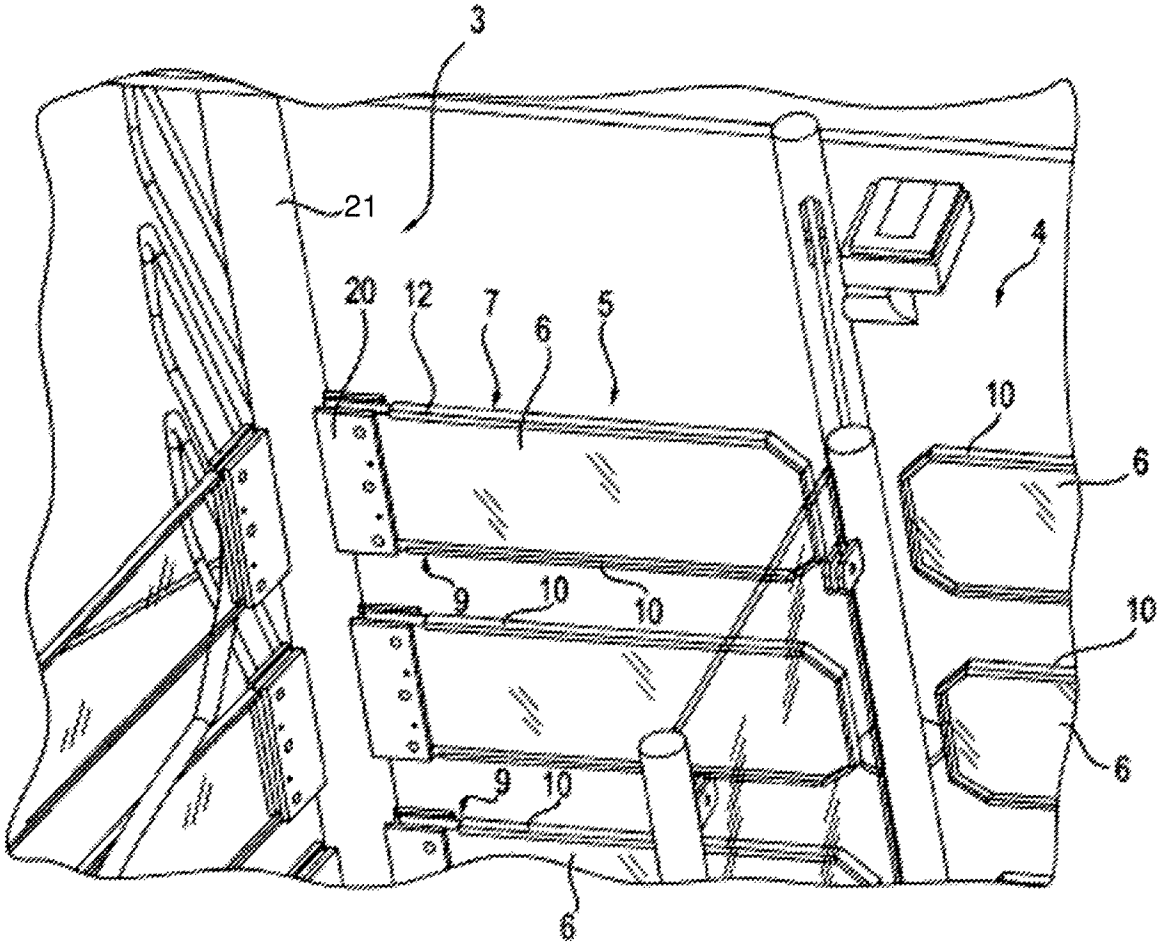
FIG. 5: a partial illustration of one of the barrier elements of the turnstile, showing the mounting of the light-emitting element to the turnstile and showing the LED lighting strip arranged on a narrow side of the transparent and light-guiding light-emitting element.

As shown in FIG. 5, the barrier elements (5) each comprise a transparent and illuminable light-emitting element (6), which can be substantially plate-shaped and can consist of a transparent, light-conducting material such as glass or plastic. Said light-emitting elements or light-emitting panels (6) are held at one of the edge sections thereof, for example, by two mounting flanges (20), between which an edge section of the respective light-emitting element (6) can be sandwiched and clamped. Alternatively or additionally, a corresponding slot can be provided in the turnstile post, into which one end of the light-emitting element (6) can be inserted, wherein a fixation foreseen to the turnstile post by means of elastic clamping, adhesive or interlocking means such as a screw can be provided. Such a fixing by means of elastic clamping, glue or positively by means of bolts or rivets or the like, can also be provided independently of a slot in the turnstile post.

The light-emitting elements (6) are each attached to the turnstile post by means of a first end section (6.1) and protrude freely with a second end section (6.2). The respective light-emitting element (6) can be clamped by means of only a narrow edge strip of the first end portion (6.1) of the light-emitting element or can be otherwise secured on the turnstile post, while the remaining, much larger part of the body of the lighting element (6) is cantilevered away from the fixing point in a free and unsupported manner. The light-emitting element can thereby have an elongate, significantly longer than wide outline, for example, in the shape of a sword, and may be clamped only at the narrow end thereof. Said first and second end portions (6.1) and (6.2) can thus form the ends in the longitudinal extension.

Incidentally, the light-emitting elements (6) project freely and, apart from the lateral clamping or fastening, have no other ways for bearing or support.

In order to display to the light-emitting elements (6) information, we can foresee that the lighting elements (6) each has a display element, in particular in the form of so-called electronic paper. The electronic paper of the display element can thereby consist of sheets or films arranged above one another, in a generally known manner, between which sheets or films the micro capsules are arranged having color pigment particles floating in a liquid, which micro capsules can be electronically loaded and aligned. The sheets are provided with appropriate electrodes in order to be able to align the color pigment particles floating in a liquid between the sheets, in the desired pixel-like manner. Such electronic paper is supplied, for example, by Fujitsu under the name "substrate-based electronic paper". Alternatively, Xerox provides an electronic paper under the brand "Gyricon".

Alternatively or in addition to such electronic paper, screens can be integrated in the light-emitting elements (6) or form said light-emitting elements at least in some sections, in particular in the form of LED or LCD flat screens in the form of tablet displays.

The illumination device (7) for illuminating the light elements (6) of the barrier elements (5) can further comprise LED light-emitting elements (12) which can be arranged on a narrow side of the light-emitting elements (6), and can be glued, for example, to the light-emitting element see FIG. 5. Said LED lighting strips (12) can be also extend along at least one of the long narrow sides of the light-emitting element (6), if necessary, also running around several narrow sides of the light-emitting element (6) or each piecewise on the upper and lower narrow side of the light-emitting element (6).

In particular, the aforementioned LED strips (12) can be arranged between the respective narrow side of the light-emitting element (6) and the frame which surrounds the respective light-emitting element (6) edge. This edging can, for example, be formed by an edge web (10) which has a U-shaped cross-section and the edges of the respective light-emitting element (6) can surround on three sides, such that the LED lighting strip (12) is seated in the bottom of the U-shaped recess of the edge web (10). Through this edge web (10), see FIG. 5, the respective LED lighting strip (12) is protected from external influences.

The light emitted by the LED light strips (12) is initiated and irradiated through said narrow sides into the light-emitting element (6), such that the light can be distributed in the light-emitting panels (6) and then completely illuminates said light-emitting panels. By breaking, the light can emerge through the largest front and rear sides of the respective light-emitting panel (6), such that the light-emitting element (6) is illuminated from the inside over the largest area.

In addition, or possibly as an alternative to such an internal illumination of the light-emitting element (6), these can optionally also be irradiated from the outside, in particular, by an edge section of the light-emitting element (6), such that the light emitted from the illumination device (7) falls, dragging at an acute angle, to the front and/or back side. For this, the illumination device (7) can comprise, for example, more LEDs or other light sources in the area of said mounting flanges (20), see FIG. 5.

The illumination device (7) can advantageously comprise different colored light sources and/or variable light sources in the color temperature, so that the barrier elements (5) can be illuminated in different colors and different lighting effects can be achieved. For example, differently colored LEDs in the form of the previously described LED light strips (12) can be provided. Here, different colored light sources can be provided on the barrier elements (5) and/or light sources having different color temperatures arranged on different barrier elements (5).

Depending on the location and purpose of the access control device (1), the illumination device (7) can be driven in various ways. For example, different lighting effects can be basically achieved when used in a casino or an amusement venue, in the form of changes in light color and/or intensity in the form of changes in the color of the illumination, light pulses by switching on and off or pulsed changes of the light color and/or intensity.

Figure 6:
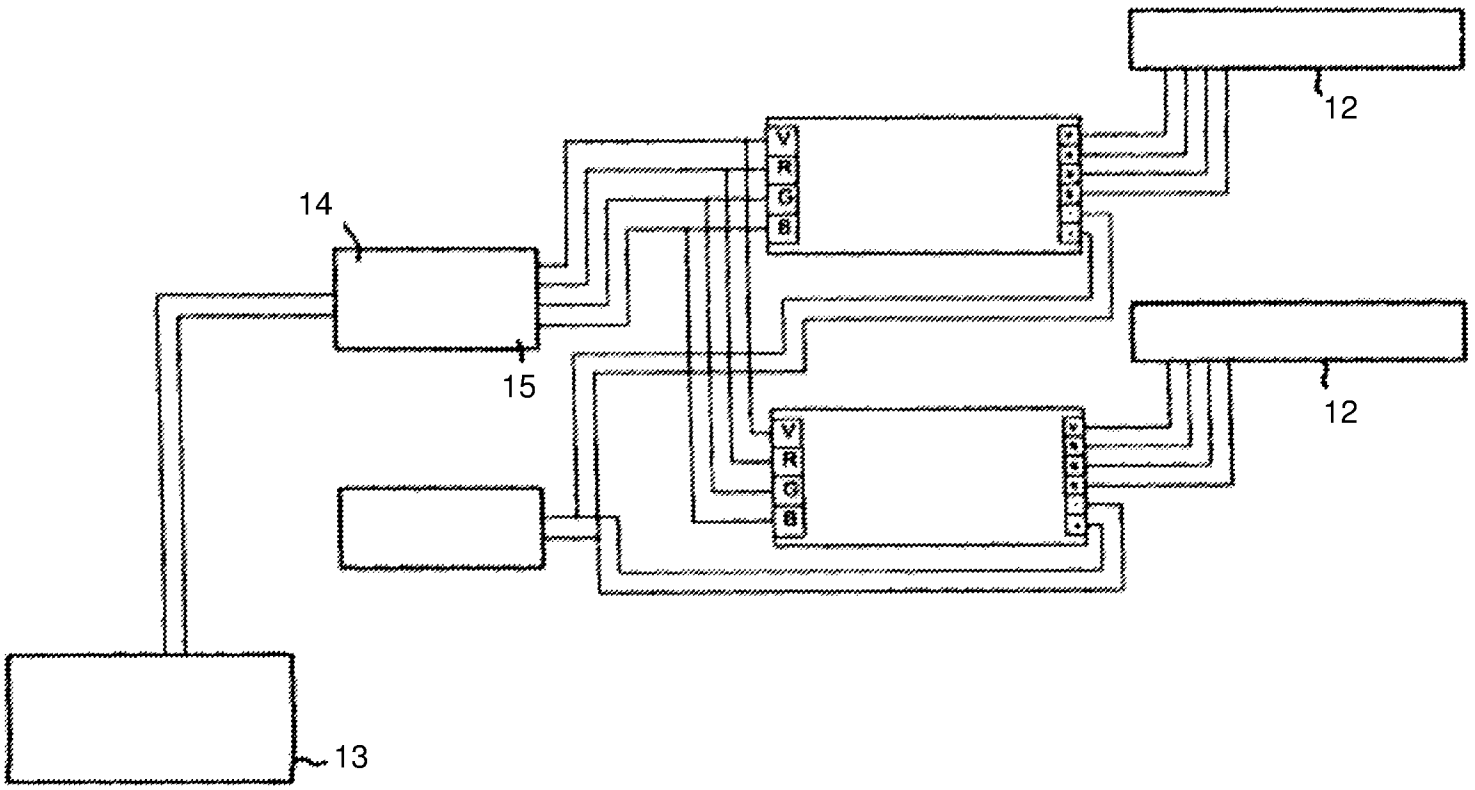
FIG. 6: a schematic circuit diagram for controlling the LED strips on the barrier elements.

In an advantageous manner, the illumination device (7) can also be driven by controllers (14 and 15) that take into account the movement of the turnstile (3) and the barrier elements (5) respectively and/or signals of the detection sensors (13), see. FIG. 6. For example, the barrier element (5) of the turnstile (3) can be lit in another way, whether the turnstile is revolving or whether the turnstile (3) is stationary. For example, pulsed or flashing lighting of the barrier elements (5) can be provided when the turnstile (3) rotates, while a static or constant illumination can be generated when the turnstile (3) is still.

Alternatively or additionally, the illumination device (7) can be variably controlled in dependence of the detection of a person seeking access or of the authorization of said person. For example, if a valid ticket or a valid entrance card is detected by the ID reader (19), a green lighting of the barrier elements (5) can be provided, while upon detection of an invalid ticket, a red illumination of the barrier elements (5) can be provided.

Figure 7:
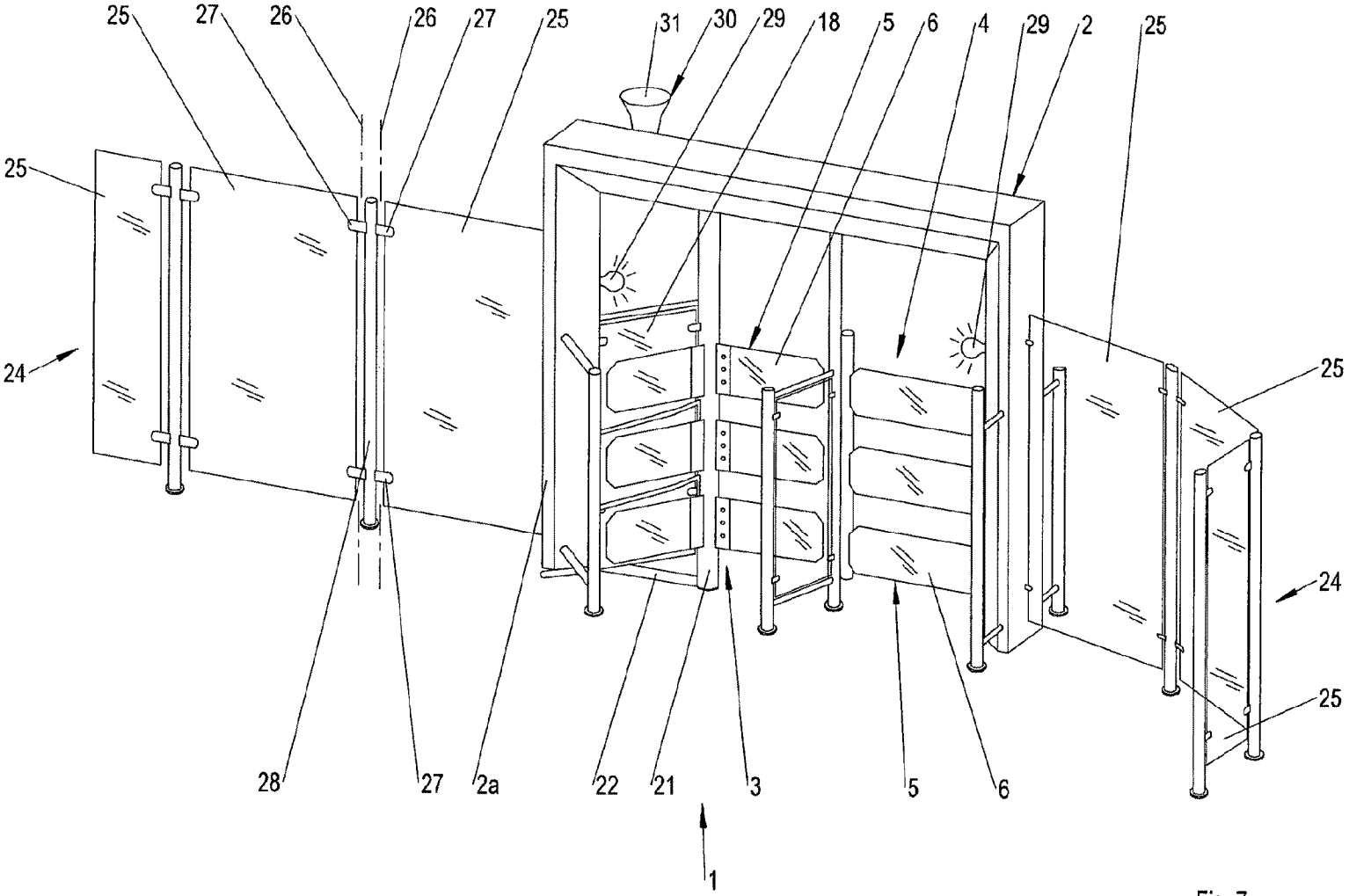
FIG. 7: a schematic, perspective view of an access control device similar to FIG. 1, in which the turnstile is mounted on a related portal bottom plate and on the portal, a modularly constructed, several side-stranded side barrier is connected.
Figure 8:
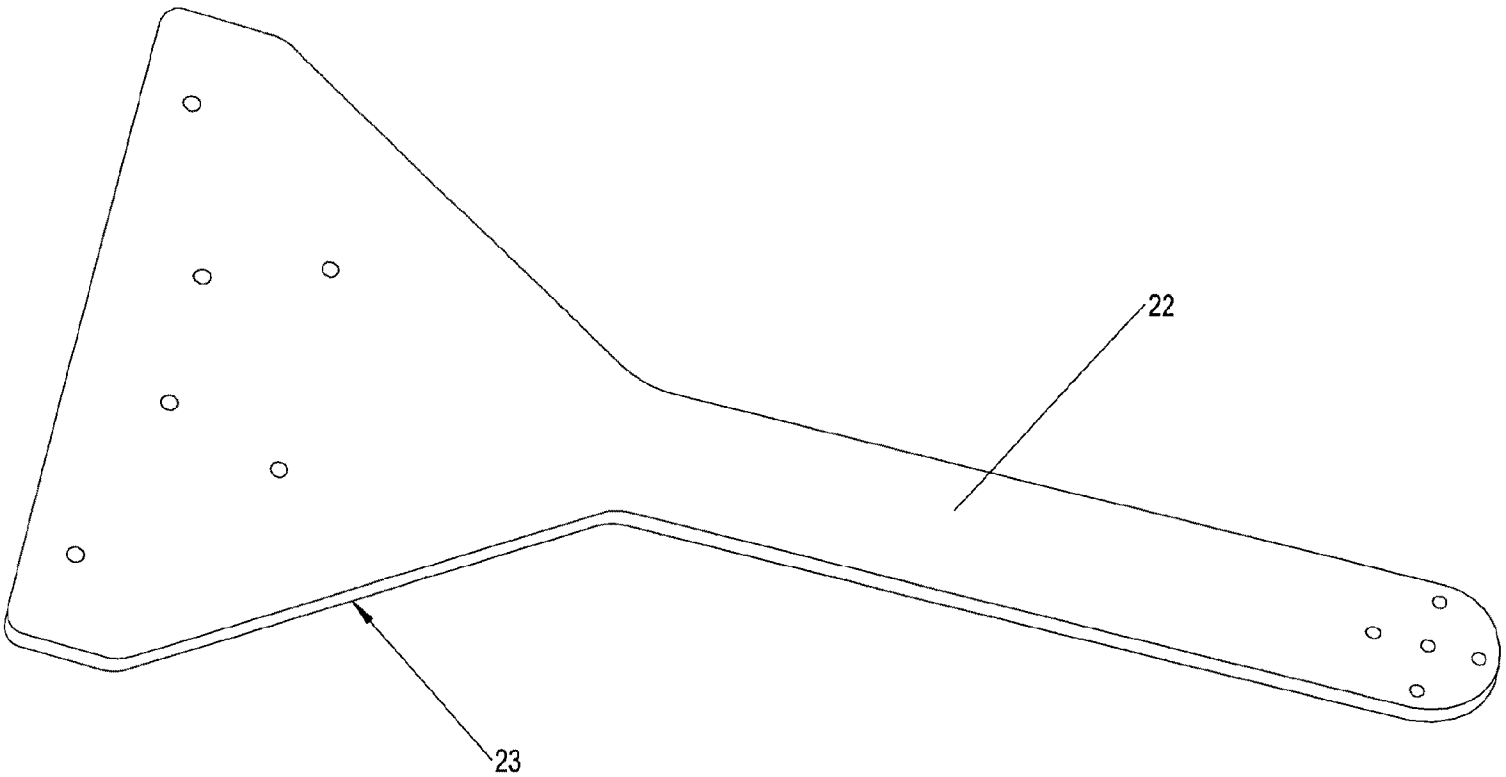
FIG. 8: a top perspective view of the supporting bottom plate of the turnstile of FIG. 7.

FIG. 7 shows another embodiment of the access control device (1), which basically corresponds to the embodiment according to FIGS. 1 to 6 in many details, in particular regarding the formation of the barrier elements (5) that can be illuminated or is similar to the embodiment according to FIGS. 1 to 6), such that reference is basically made to the above description. Basically, all embodiments of FIGS. 1 to 6 also apply to FIGS. 7 and 8. The embodiment according to FIGS. 7 and 8 have the following further characteristics:

As FIGS. 7 and 8 show, the turnstile (3) can be advantageously braced, in particular the turnstile post (21) thereof, on a base plate (22), which may advantageously be connected to the portal (2) enclosing the access, in particular the portal post (2*a*) of said portal. Said base plate (22) can be rigidly connected to the portal post (2*a*) at the lower end of said portal post (2*a*), for example, be screwed or attached in some other way and can extend to the lower end of the turnstile post (21), which, for example, can be supported via a roller or plain bearing or another pivot bearing on the base plate (22) in a rotatable manner. As a result, no ground anchoring for the turnstile (3) is necessary. In addition, the whole access control device (1) can be set up in a simple manner at different locations, for example, pushed along or relocated on the floor, without the portal (2) having to be adjusted relative to the turnstile (3).

The base plate (22) forms advantageously a free-standing, anchorage-free ground contact means (23) whose position can be variably adjusted for the barrier support of the movable barrier element (5), which barrier carrier can be in the form of the turnstile (3) shown.

Furthermore, as FIG. 7 shows, a side barrier (24) having a modular design can connect to the portal (2) on the side, which side barrier can be composed of a plurality of side panels (25) variably in different configurations.

Said side panels (25) can form, for example, wall elements, for example in the form of at least partially transparent panels made of an at least partially transparent material such as glass or plastic, for example, Plexiglas, whereby, instead of such sheet panel elements, other side panels, for example, in the form of a grid, of a slatted fence, or of similar embodiments can be provided. If the side parts (25) include partially transparent and/or light-guiding panels as mentioned above, the side panels (25) can be basically lit and be provided with an illumination device, as previously described for the barrier elements (5), such that different lighting effects can be brought to the area of the side panels (25). In this respect, the barrier element (5) is subject to the previous description.

The side panels (25) are connected to one another and are releasable, namely advantageously such that the side panels (25) can be set-up to one another in different angular positions in an articulated manner. In particular, between adjacent side panels (25), means of hinging articulation can be provided, that can realize an upright hinge axis such that adjacent side panels (25) can be hinged relative to each other along the side thereof, facing neighboring side edges.

As shown in FIG. 7, connector posts (28) can be provided in between the side panels (25), on which connector posts the side panels (25) may be respectively redirected about a vertical hinge axis (26) in a pivotable manner. The connecting posts (28) can thereby have their own coupling means (27) for each connectable side panel (25), such that the adjacent side elements (25) can pivot about two separate hinge axes. However, it is understood that a common hinge axis (26) may be provided between two adjacent side panels (25).

The side limit (24) is advantageously also hinge-connected to the portal (2), and thus likewise advantageously around an upright hinge axis (26). Here, the portal posts (2*a*) and/or the side panels (25) can be equipped with the corresponding coupling means (27), see FIG. 7.

To avoid climbing over the turnstile (3) and/or over the neighboring exit gate and/or passing or crawling below the lowest barrier elements (5), a sensor monitoring the space above and below the turnstile (3) or the top and bottom barrier element (5) can be provided. A corresponding sensor installation (29) may be configured for example in the form of a light barrier and/or can comprise radar sensors that monitor said defined area. Advantageously, the sensor installation (29) can be integrated into the portal (2) or be attached thereto. For example, light barrier sensor elements can be mounted on the portal posts (2*a*), placed opposite each other, such that the light barrier sensor elements communicate with each other above and/or below the upper and lower barrier elements and detect unauthorized passage. See FIG. 7.

Furthermore, as FIG. 7 shows, an acoustic device can be provided, for example attached to the portal (2), such that information and signals can also be transmitted acoustically. For example, an acoustic notification on actions related to the access control such as release, refusing access, activating light barrier, etc. can occur. For example, the message "Please pass" can communicate to a user that the turnstile (3) is unlocked. Alternatively or additionally, the acoustic device can be connected to the aforementioned sensor installation (29) for signaling unauthorized climbing over the turnstile by means of an alarm. The acoustic device (30) can include a speaker (31), for example, on portal 2, see FIG. 7.

The invention claimed is:

1. An access control device comprising:

at least one turnstile (3), wherein each of the at least one turnstile (3) comprises a turnstile post (21) defining a vertical axis and a plurality of barrier elements (5), each of said plurality of barrier elements (5) extending fixedly relative to the axis movable between a blocking position and an unblocking access position;

each of said plurality of barrier elements (5) comprising an illumination device (7) comprising a light emitting panel (6) that is transparently or translucently formed and having illumination visible beyond the device; and controllers that vary the illumination in at least one of color or intensity as a function of rotation around the axis of the turnstile (3).

2. The access control device according to claim 1, wherein the illumination device (7) comprises at least one display element which is integrated in the light-emitting panel (6) or forms the light-emitting panel (6).

3. The access control device according to claim 2, wherein the display element comprises a display module of electronic paper having an image storage function for variable representation of information, wherein the electronic paper is connected to the light-emitting panel (6) or forms a layer of the light-emitting panel (6).

4. The access control device according to claim 2, wherein the display element consists of a flat screen in the form of an LCD or an LED tablet display.

5. The access control device according to claim 1, wherein the illumination device (7) is attached to the light-emitting panel (6) in such a way that one of said plurality of barrier elements (5) can be illuminated from inside or can be shone through such that at least a front side of the light-emitting panel (6) can be illuminated in a planar manner by the illumination device (7).

6. The access control device according to claim 5, wherein the illumination device (7) further comprises at least one light source (8) in the form of an LED lighting strip (12), which is arranged on a narrow side of the light-emitting panel (6) and irradiates light to said narrow side, such that on said narrow side of the light-emitting panel (6) light from the illumination device (7) propagates in the light-emitting panel (6) and is radiated through the front side thereof.

7. The access control device according to claim 1, wherein the illumination device (7) contains different colored light sources (8), which are arranged and distributed along a periphery of the light-emitting panel (6).

8. The access control device according to claim 1, wherein the light-emitting panel (6) is formed at least in some sections in a reflective or light-scattering manner, and wherein the illumination device (7) further comprises at least one light source (8) arranged on an edge of the light-emitting panel (6), where the at least one light source (8) illuminates the front side of the light-emitting panel (6).

9. The access control device according to claim 1, wherein the turnstile (3) forms an access turnstile (3) and in addition to the access turnstile (3) at least one emergency exit barrier (4) is provided wherein the emergency exit barrier (4) comprises at least one illuminable barrier element.

10. The access control device according to claim 9, wherein the plurality of barrier elements are illuminated differently whether the turnstile (3) is revolving or whether the turnstile (3) is stationary.

11. The access control device according to claim 1, further comprising detection sensors (13) for detecting an access seeker or an authorization of the access seeker and controlling the illumination in dependence of a signal of the sensors (13).

12. The access control device according to claim 1, wherein the turnstile (3) is mounted on a barrier carrier, which further comprises a ground contact (23) that is designed in a detached manner for setting up said plurality of barrier elements (5) on a floor without anchors and with variable positioning.

13. The access control device according to claim 12, wherein the barrier carrier further comprises a base plate (22), on which the turnstile post (21) is supported, wherein an underside of the base plate (22) forms said ground contact (23) or wherein the base plate (22) is connected to said ground contact (23).

14. The access control device according to claim 13, wherein said base plate (22) connects the turnstile post (21) with a side limit which surrounds the access device in the form of a portal post (2*a*).

15. The access control device according to claim 14, wherein the turnstile post (21) is pivotally supported at a lower end via the base plate (22) on the floor and by an upper end that is hinged to a portal cross member (2*b*), which is connected to said portal post (2*a*).

16. The access control device according to claim 1, further comprising one or more side barriers (24) extending from at least one side of the access control device, the one or more side barriers (24) having a modular design and can be composed of a plurality of side parts (25), where said plurality of side parts (25) are variably joinable in different angular positions and which together form the one or more side barriers (24).

17. The access control device according to claim 16, wherein one side part (25) of said plurality of side parts (25) is connected to an other side part (25) of the plurality of side parts in an articulated manner by a coupling (27) and can be positioned in various angular positions to each other or wherein adjacent side parts (25) of the plurality of side parts (25) are connected to each other by an upright hinge axis (26).

18. The access control device according to claim 16, wherein said one or more side barriers (24) can be connected in an articulated manner to the access control device with a coupling (27) in the form of a portal post (2*a*), and said one or more side barriers (24) can be brought into various angular positions with respect to said access control device.

19. The access control device according to claim 1, further comprising at least one sensor installation (29) for monitoring a spatial region above or below or on a set of sides of one of said plurality of barrier elements (5).

20. The access control device according to claim 19, wherein the at least one sensor installation (29) is controllable depending on an operating state of the one of said plurality of barrier elements (5) such that an alarm signal upon detection of an object in the monitored spatial region is suppressed when the one of said plurality of barrier elements (5) is in the access position.

21. The access control device according to claim 1 where said plurality of barrier elements (5) are vertically displaced from one another and forming a plurality of locking arms.

* * * * *